US008607761B2

(12) United States Patent
Nagahashi et al.

(10) Patent No.: US 8,607,761 B2
(45) Date of Patent: Dec. 17, 2013

(54) LUBRICATION STRUCTURE FOR BEARING SECTION

(75) Inventors: Yoshiki Nagahashi, Wako (JP); Kazuya Tajiri, Wako (JP); Fumiaki Okubo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/552,958

(22) Filed: Jul. 19, 2012

(65) Prior Publication Data

US 2013/0025562 A1 Jan. 31, 2013

(30) Foreign Application Priority Data

Jul. 26, 2011 (JP) ..... 2011-162877

(51) Int. Cl.
*F01M 11/02* (2006.01)

(52) U.S. Cl.
USPC ..... 123/196 R; 123/192.2; 123/195 C; 384/400; 184/104.2

(58) Field of Classification Search
USPC .... 123/196 R, 198 DA, 196 S, 195 A, 195 C, 123/195 S, 195 AC, 198 R, 198 D, 198 E, 123/196 CP, 192.2; 184/104.2, 6.12; 384/400, 403, 433, 462, 376, 371, 322, 384/130
See application file for complete search history.

(56) References Cited

U.S. PATENT DOCUMENTS 3,703,178 A * 11/1972 Schreiber et al. ..... 184/6.5
4,231,266 A * 11/1980 Nishikawa et al. ..... 74/467
5,560,619 A * 10/1996 Acree ..... 277/637

FOREIGN PATENT DOCUMENTS

JP 3060628 4/2000

* cited by examiner

*Primary Examiner* — Hung Q Nguyen
(74) *Attorney, Agent, or Firm* — Rankin, Hill & Clark LLP

(57) ABSTRACT

A lubrication structure for a bearing section of an internal combustion engine including a crankcase having a wall portion, a bearing secured to the wall portion, a rotational shaft supported for rotation by the bearing, and a bearing restriction member disposed on a side face of an outer race portion of the bearing and configured to suppress coming off of the bearing, wherein an oil receiving portion formed in a swollen state on the wall portion along an outer periphery on the outer side of an outer periphery below the center axis of the bearing, and an oil reserve section is provided so as to extend over the oil receiving portion and the bearing restriction member.

20 Claims, 10 Drawing Sheets

FIG. 6
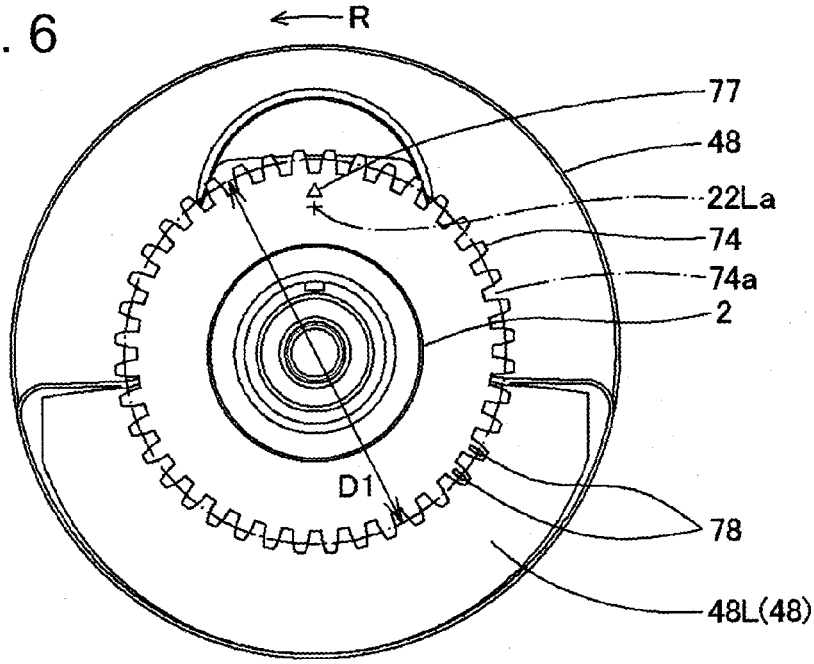
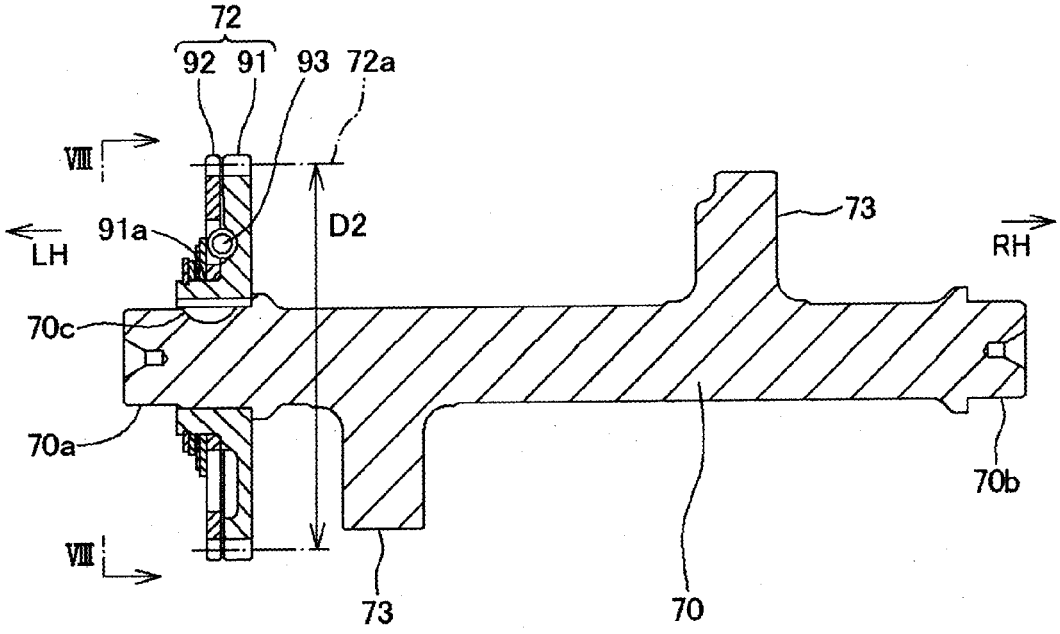
FIG. 7

LUBRICATION STRUCTURE FOR BEARING SECTION

BACKGROUND OF THE INVENTION

1. Field of the Invention

The present invention generally relates to a lubrication structure for a bearing section of an internal combustion engine and, more particularly, to a lubrication structure for a bearing section using a simple oil supplying device.

2. Description of Related Art

An internal combustion engine for a motorcycle wherein a breather plate, which configures a breather by being attached to an inner wall of a crankcase on the speed change gear accommodation side, is utilized such that a retainer section (bearing restriction section) for preventing a bearing from coming off, which bearing supporting a countershaft of a speed change gear, is provided at a portion of the breather plate. Such a internal combustion engine structure is disclosed in Japanese Patent No. 3060628.

In the internal combustion engine disclosed in Japanese Patent No. 3060628, a lower portion of the crankcase serves as an oil reserve chamber, and part of the speed change gear is lubricated by being dipped in oil or the oil is agitated or the like by the gear wheels or the like to lubricate the inside of the crankcase. However, since the countershaft and the bearing described above are exposed upwardly from the oil level, a device for supplying oil to the bearing is required. However, if it is intended to specially provide an oil supply device, then there is the possibility that the structure may be complicated and the number of parts may increase.

SUMMARY OF THE INVENTION

Taking the prior art described above into consideration, it is a subject of the present invention to provide a lubrication structure for a bearing section wherein a bearing, which is secured to a wall portion of a crankcase of an internal combustion engine such that it is exposed upwardly from an oil level, can be lubricated by simple oil supplying device.

In order to solve the subject described above, one aspect of the present invention provides a lubrication structure for a bearing section of an internal combustion engine including:

a crankcase having a wall portion;

a bearing secured to the wall portion;

a rotational shaft supported for rotation by the bearing; and a bearing restriction member disposed on a side face of an outer race portion of the bearing and configured to suppress the bearing from coming out of the wall portion, wherein an oil receiving portion formed in a swollen state on the wall portion on an outer periphery of the bearing and disposed below a center axis of the bearing, and an oil reserve section is provided so as to extend over the oil receiving portion and the bearing restriction member.

Therefore, the oil for lubrication that flows along the wall portion of the crankcase can be accumulated in the oil reserve section that extends over the oil receiving section and the bearing restriction member, and lubrication of the bearing is permitted thereby. Accordingly, the lubrication structure for the bearing including the simple oil supplying device that can utilize the bearing restriction member of the bearing to lubricate the bearing without providing special oil supplying means is obtained.

According to a second aspect of the invention, the bearing restriction member is formed so as to extend, in a state in which the bearing restriction member is attached to the oil receiving portion, from the oil receiving portion toward the center axis of the bearing and extend at least along a side face rather near to the outer periphery of the bearing. Since the bearing restriction member extends toward the center axis of the bearing farther than the oil receiving section and is attached to the oil receiving section so as to extend along the side face rather outwardly of the bearing, the capacity of the oil reserve section increases, and oil supply to the bearing is carried out more preferably.

According to a further aspect of the invention, the oil receiving portion is formed in an arcuate shape that extends along the outer periphery of the bearing and is concave in an upward direction. Since the oil receiving section is formed in an arcuate shape that is concave in the upward direction along the outer periphery of the bearing, the oil amount that can be accumulated in the oil reserve section increases.

In accordance with another aspect of the invention, the bearing has an outer race portion secured to the wall portion, and the bearing restriction member is formed such that a portion thereof that extends toward the center axis of the bearing from the oil receiving portion extends to the center axis side of the bearing farther than the outer race portion. Therefore, the oil is supplied positively to the sliding region of the bearing by the bearing restriction member that extends to the center axis side of the bearing from the outer race portion of the bearing.

In accordance with another aspect of the invention, the bearing restriction member serves also as a bearing restriction member for a second bearing for a second rotational shaft positioned adjacent the rotational shaft. Therefore, the bearing restriction member can be utilized as the bearing restriction member for the second bearing of the second rotational shaft without providing a bearing restriction member separately for both of the bearings, and reduction of the number of parts can be achieved.

In accordance with another aspect of the invention, the bearing restriction member is configured so as to extend to a shaft end portion of a further shaft supported by the wall portion and contact with the shaft end portion. Thus, the bearing restriction member can be used as a coming off preventing device and to retain or hold the further shaft, and a reduction of the number of parts can be achieved.

Based upon another aspect of the invention, a boss portion of a fastening device for attaching the bearing restriction member to the oil receiving portion is formed integrally with the oil receiving portion on the wall portion. Since the boss portion of the fastening device is integrated, rigidity around the oil receiving section is enhanced.

In accordance with another aspect of the invention, a boss portion of a fastening device for attaching the bearing restriction member to the wall portion above the rotational shaft is disposed in a displaced relationship from a position just above the center axis of the bearing of the rotational shaft. Therefore, obstruction to inflow of oil to the oil receiving section, which may possibly occur where the boss portion of the fastening device above the rotational shaft is positioned just above the center axis of the bearing, is suppressed, and this can contribute to stabilized lubrication.

In accordance with another aspect of the invention, the bearing restriction member is formed by cutting away one of the opposite sides, which sandwich the rotational shaft therebetween, of a portion thereof between a portion positioned above the rotational shaft and another portion positioned below the rotational shaft. When the bearing restriction member is formed annularly around the rotational shaft, there is the possibility that the oil may flow down along around the annular portion and may not readily enter the oil receiving section. However, since the portion of the bearing restriction member between the upper portion and the lower portion with respect to the rotational shaft on one of the sides between which the rotational shaft is sandwiched is cut away to form the cutaway portion, it becomes easy for the oil to flow from the cutaway portion into the oil receiving portion, and this can contribute to stabilized lubrication.

BRIEF DESCRIPTION OF THE DRAWINGS

FIG. 6 is a view taken in a direction indicated by arrow marks VI-VI.

FIG. 7 is a sectional view in an axial direction of a balancer shaft and a balancer driven gear wheel shown in and taken out from FIG. 2.

DETAILED DESCRIPTION OF THE PREFERRED EMBODIMENTS

A lubrication structure for a bearing section of an internal combustion engine of an embodiment according to the present invention is described with reference to FIGS. 1 to 12.

It is to be noted that such directions as forward, rearward, leftward, rightward, upward and downward directions in the description of the present specification and the claims are represented with reference to the direction of a small size vehicle in a state in which the internal combustion engine with a balancer for a motorcycle according to the present embodiment is mounted on the vehicle.

Further, in the figures, an arrow mark FR denotes a forward direction of the vehicle, LH a leftward direction of the vehicle, RH a rightward direction of the vehicle, and UP an upward direction of the vehicle.

Figure 1:
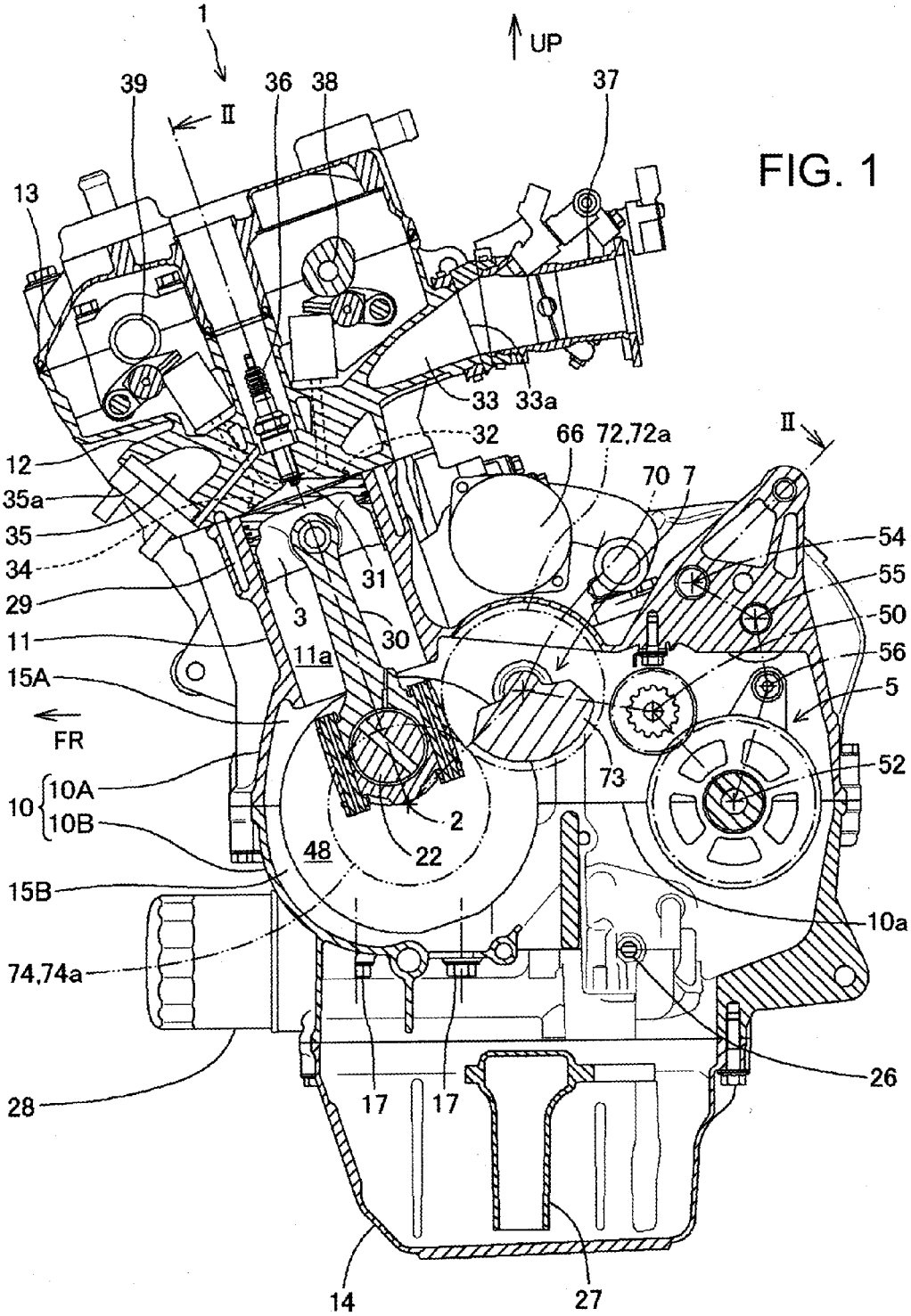
FIG. 1 is a left side elevational sectional view of an internal combustion engine for a motorcycle with a balancer according to an embodiment of the present invention.

FIGS. 1 to 12 relate to an embodiment of the present invention, and in FIG. 1, an internal combustion engine with a balancer (hereinafter referred to as internal combustion engine 1) is shown in a posture in which it is mounted on a vehicle (not shown).

The internal combustion engine 1 according to the present embodiment is a water-cooled straight two-cylinder four-stroke internal combustion engine mounted on a motorcycle (not shown), which is a vehicle on which the internal combustion engine 1 is mounted, with a crankshaft 2 thereof oriented in a vehicle widthwise direction of the motorcycle, that is, in the leftward and rightward direction.

As shown in FIG. 1, a crankcase 10 in which the crankshaft 2 is disposed in the vehicle widthwise direction and supported for rotation is formed in a two-part configuration in which it is configured from two upper and lower divisional parts across a parting face 10*a* centered at the crankshaft 2. On the upper side crankcase 10A, a cylinder block 11 formed from two cylinder bores 11*a* arrayed in series (refer to FIG. 2) and formed integrally and a cylinder head 12 fastened to the cylinder block 11 are placed in order and provided uprightly in a rather forwardly inclined relationship. A cylinder head cover 13 is placed on and fastened to the cylinder head 12. Meanwhile, an oil pan 14 is attached under the lower side crankcase 10B.

Figure 2:
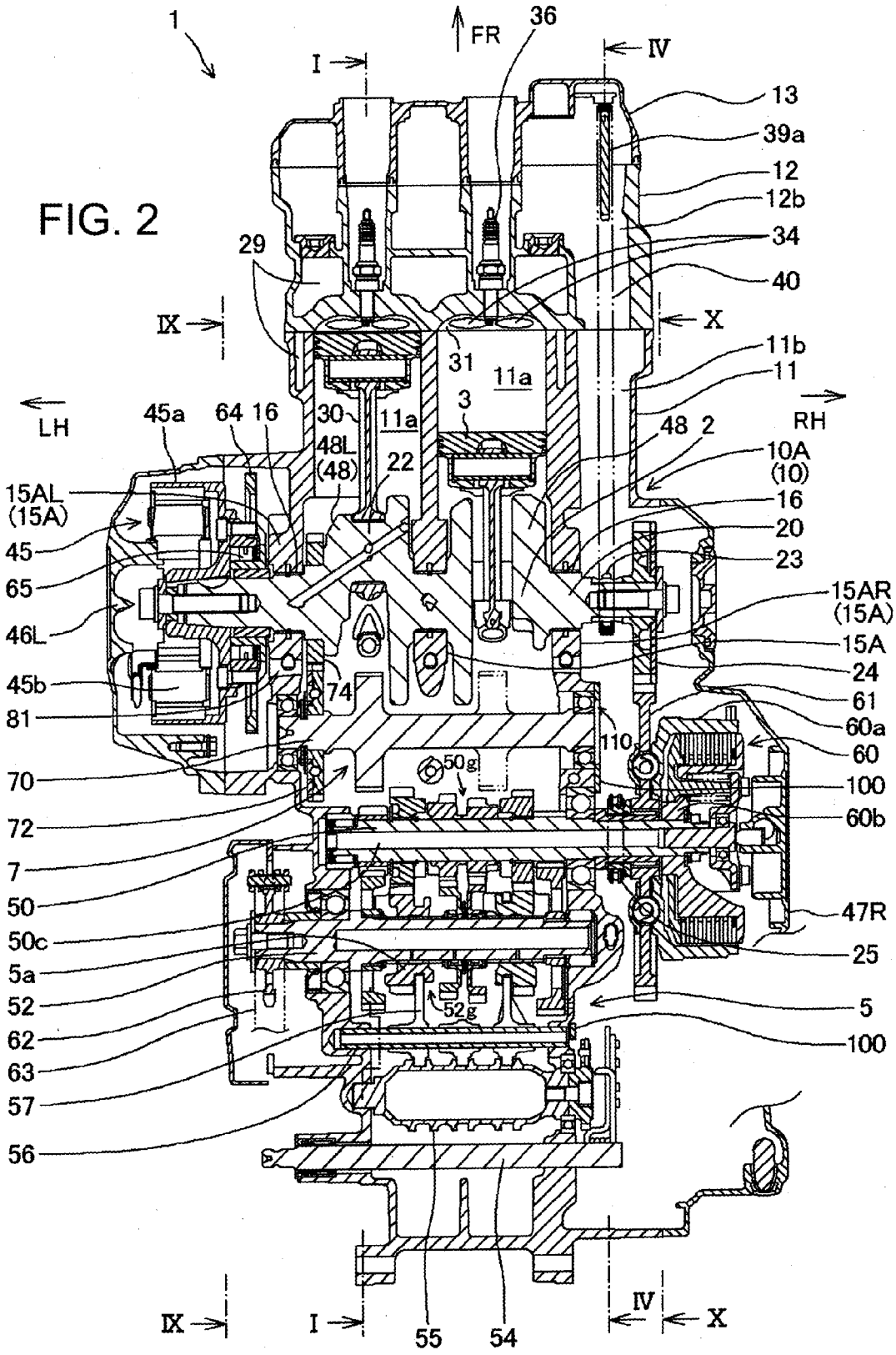
FIG. 2 is a sectional developed view of the internal combustion engine with a balancer taken along line II-II in FIG. 1. It is to be noted that FIG. 1 corresponds to a sectional view taken along line I-I in FIG. 2.

Referring to FIG. 2, journal walls 15A and 15B (A indicates the upper side and B indicates the lower side: this similarly applies in the following description. However, in FIG. 2, only the upper side journal wall 15A is shown as indicated by a development sectional line II-II in FIG. 1) support journal portions 20 of the crankshaft 2 for rotation in such a manner as to sandwich the same from above and below with a main bearings (journal bearings) 16 interposed therebetween. Since the internal combustion engine 1 is of the series two-cylinder type, the crankshaft 2 has three journal portions 20 and is supported for rotation by three journal portions 20 in both of the upper side crankcase 10A and the lower side crankcase 10B.

Of each three journal walls 15A and 15B, the left end side journal walls 15AL and 15BL and the right end side journal walls 15AR and 15BR (A indicates the upper side and the B indicates the lower side: this similarly applies also in the following description. It is to be noted that, in FIG. 2, only upper side ones are shown as described hereinabove) extend rearwardly with respect to the crankshaft 2 and configure a pair of left and right wall portions of the crankcase 10 such that they support not only the crankshaft 2 but also a main shaft 50 and a countershaft 52 of a speed change gear 5 disposed in the crankcase 10 rearwardly with respect to the crankshaft 2 and a balancer shaft 70 of a balancer mechanism 7 for rotation and in parallel to the crankshaft 2.

The upper side crankcase 10A and the lower side crankcase 10B are fastened integrally with each other by bolts, with the parting faces 10*a* thereof put together. In each three journal walls 15A and 15B in the upper side crankcase 10A and the lower side crankcase 10B, stud bolts ("fastening bolt" in the present invention (refer to FIG. 1)) 17 extend, in the front and rear sandwiching semicircular arcuate portions, which configure three crankshaft supporting holes 2H (refer to FIGS. 3 and 9) that hold the crankshaft 2, straightly upwardly from below through the lower side crankcase 10B, and are screwed into and tightened to elongated female threaded holes (refer to FIG. 9) of the upper side crankcase 10A.

It is to be noted that the upper side crankcase 10A and the lower side crankcase 10B are fastened not only by the stud bolts 17 described hereinabove but also by a plurality of bolts 19 at required locations (refer to FIG. 4).

A piston 3 is fitted for back and forth sliding movement in a cylinder bore 11*a* of each of the two cylinders of the cylinder block 11 formed integrally on the upper side crankcase 10A. The piston 3 is connected to a crankpin portion 22 of the crankshaft 2 through a connecting rod 30.

As shown in FIG. 1, in the cylinder head 12, for each cylinder bore 11*a*, a combustion chamber 31 is formed in an opposing relationship to the piston 3; an intake port 33, which is open to the combustion chamber 31 and is opened and closed by a pair of intake valves 32 extends rearwardly; an exhaust port 35, which is opened and closed by a pair of exhaust valves 34 extends forwardly; and an ignition plug 36 facing the combustion chamber 31 is mounted.

It is to be noted that a throttle body 37 is connected to an upstream side opening 33*a* of the intake port 33, and an air cleaner is connected to the upstream of the throttle body 37 through an intake pipe (not shown). A muffler is connected to a downstream side opening 35*a* of the exhaust port 35 through an exhaust pipe (not shown).

Each intake valve 32 and each exhaust valve 34 are driven to open and close in synchronism with rotation of the crankshaft 2 by an intake camshaft 38 and an exhaust camshaft 39 supported for rotation on the cylinder head 12, respectively. To this end, cam sprocket wheels 38*a* and 39*a* are fitted at a right end portion of the camshafts 38 and 39, respectively, and a cam chain 40 extends between a driving sprocket wheel 23 fitted in the proximity of the right end portion of the crankshaft 2 and the cam sprocket wheels 38*a* and 39*a* (refer to FIGS. 2 and 4) such that the camshafts 38 and 39 are driven to rotate at a rotational speed equal to one half that of the crankshaft 2.

Figure 4:
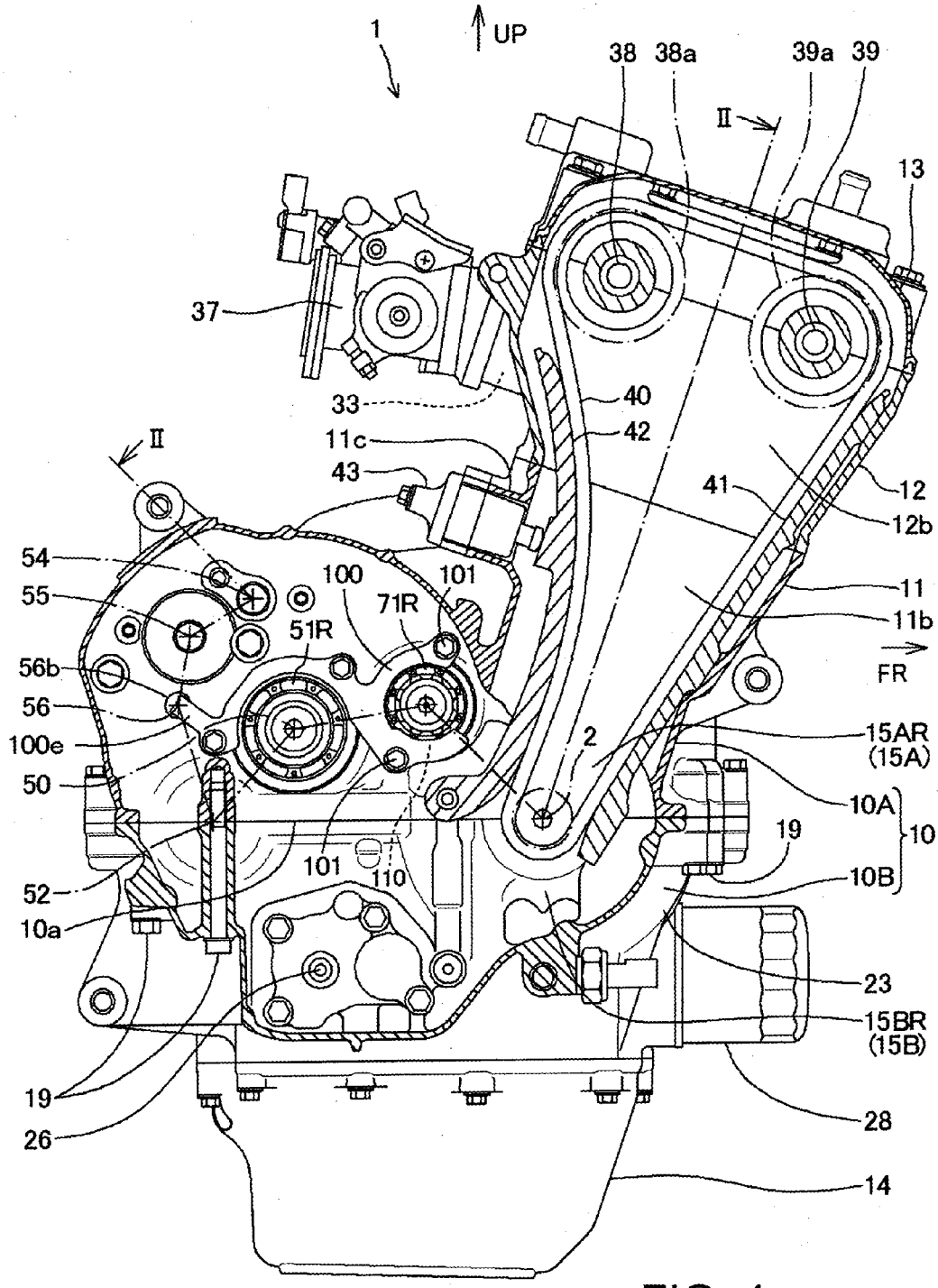
FIG. 4 is a right side sectional view of the internal combustion engine with a balancer taken along line IV-IV in FIG. 2. It is to be noted that FIG. 2 corresponds to a sectional developed view taken along line II-II in FIG. 4.

As shown in FIG. 4, cam chain chambers 11*b* and 12*b* for disposing the cam chain 40 therein are formed at a right end portion of the cylinder block 11 and the cylinder head 12 (refer to FIG. 2). In the cam chain chambers 11*b* and 12*b*, cam chain guides 41 and 42 are provided forwardly and rearwardly along the cam chain 40, respectively, and the rear side cam chain guide 42 presses the cam chain 40 under the bias by a cam chain tensioner 43 of the hydraulic pipe to apply suitable tension to the cam chain 40. The cam chain tensioner 43 is attached to a tensioner holder 11*c* which projects rearwardly from a rear face of a right end portion of the cylinder block 11.

On the other hand, as shown in FIG. 2, an outer rotor 45*a* of an ac generator 45 is fitted on a left end portion of the crankshaft 2, which projects leftwardly from the left end side journal walls 15AL and 15BL that form a left side wall portion of the crankcase 10. The ac generator 45 is covered with a generator cover 46L, which is attached to the left end side journal walls 15AL and 15BL. An inner stator 45*b*, having generator coils of the ac generator 45, is supported on the inner side of the generator cover 46L and disposed in the outer rotor 45*a*.

In the following, referring to FIG. 3, which is an enlarged view of a portion in FIG. 2 in which the shafts are supported for rotation on the crankcase 10, the speed change gear 5 is disposed rearwardly with respect to the crankshaft 2 in the crankcase 10.

The speed change gear 5 is a gear wheel type speed change gear of the constant mesh type, and the main shaft 50 of the speed change gear 5 is supported for rotation at an obliquely upward position rearwardly of the crankshaft 2 (refer to FIG. 1) on the left end side journal wall 15AL and the right end side journal wall 15AR, which form a pair of wall portions, in the upper side crankcase 10A through a left bearing 51L and a right bearing 51R, respectively. In the present embodiment, the left bearing 51L is a needle bearing and the right bearing 51R is a ball bearing.

Further, sandwiched between the parting faces 10*a* of the upper side crankcase 10A and the lower side crankcase 10B rearwardly of the crankshaft 2, the countershaft 52 is supported for rotation on the left end side journal walls 15AL and 15BL and the right end side journal walls 15AR and 15BR, which form a pair of wall portions, through a left bearing 53L and a right bearing 53R, respectively. In the present embodiment, the left bearing 53L is a ball bearing, and the right bearing 53R is a needle bearing.

Speed change gear wheel groups 50*g* and 52*g* mounted on the main shaft 50 and the countershaft 52 parallel to the crankshaft 2 mesh at paired gear wheels thereof with each other, and gear wheel switching is carried out by a movement of a gear 5*a*, which is spline fitted with a shaft and serves as a shifter, by a speed changing operation mechanism to carry out speed change.

Figure 3:
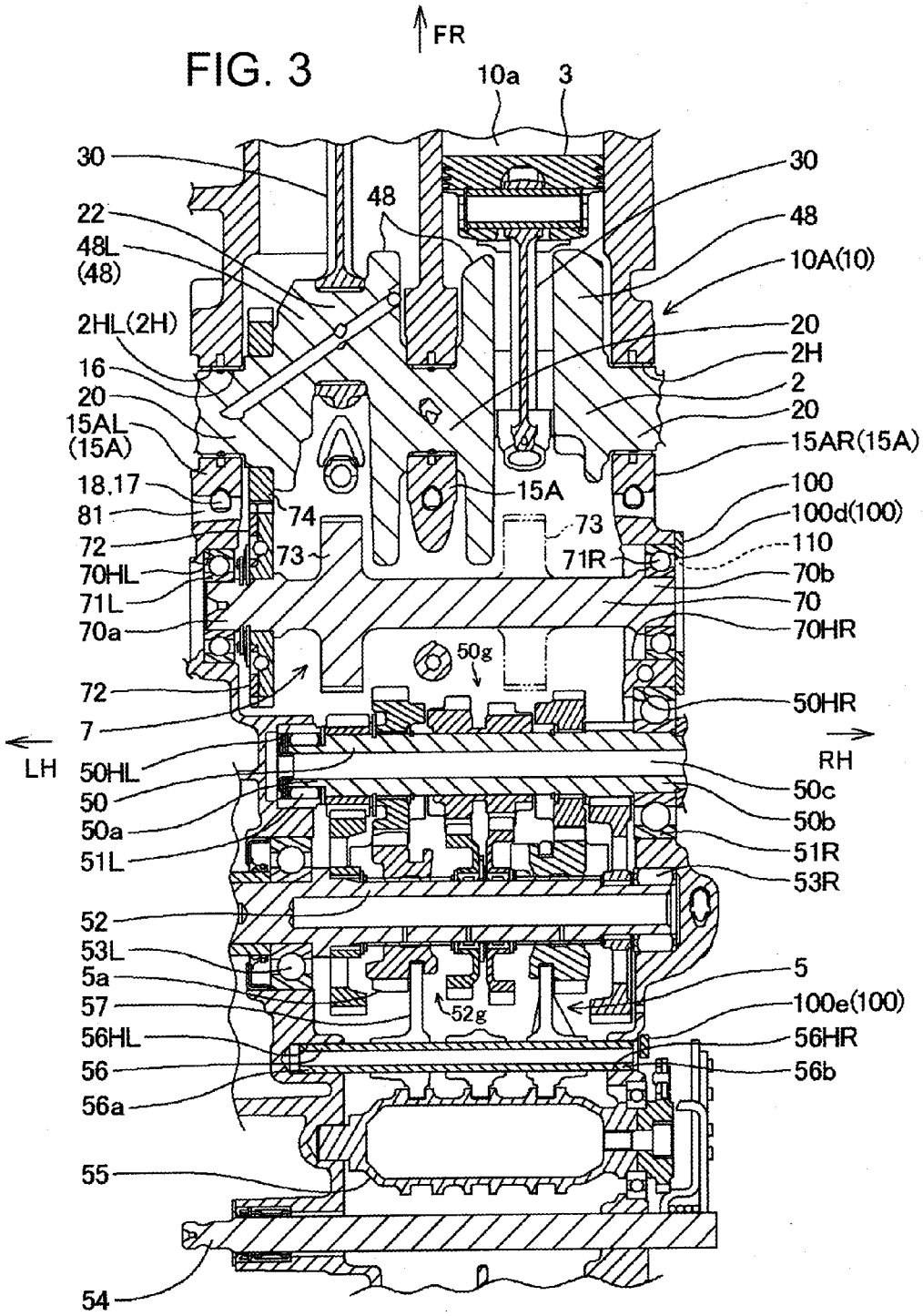
FIG. 3 is an enlarged view of a region in which shafts are supported for rotation on a crankcase.

In particular, referring to FIG. 3, if a shift spindle 54 supported for rotation on the left end side journal wall 15AL and the right end side journal wall 15AR, which serve as a pair of wall portions of the upper side crankcase 10A, is operated to rotate by an operator, then a shift drum 55 supported for rotation on the paired wall portions 15AL and 15AR is rotated to move a shift fork 57, which is supported for leftward and rightward sliding movement on a shift fork supporting shaft 56 supported on the paired wall portions 15AL and 15AR, and engages on one end side thereof with the shift drum 55, leftwardly or rightwardly.

The shift fork 57 engages on the other end side thereof with the gear 5*a* serving as a shifter in the speed change gear wheel groups 50*g* and 52*g*, and movement of the gear 5*a* serving as a shifter is carried out by the shift fork 57 to carry out speed change by a speed change operation mechanism, which is configured from the shift spindle 54, shift drum 55, shift fork 57 and so forth.

As shown in FIG. 2, a friction clutch 60 of the multi-plate type is provided at a right end portion of the main shaft 50, and a primary driven gear wheel 61 supported for rotation together with a clutch outer 60*a* of the friction clutch 60 and a primary driving gear wheel 24 secured to the right end of the crankshaft 2 mesh with each other to configure a primary speed reduction mechanism.

A clutch inner 60*b*, which is the output side of the friction clutch 60, is kept in spline fitting with the main shaft 50, and rotation of the crankshaft 2 is transmitted to the main shaft 50 through the primary speed reduction mechanism 24 and 61 and the friction clutch 60.

The primary driving gear wheel 24 and the friction clutch 60 are covered on the right side thereof with a right crankcase cover 47R, and the right crankcase cover 47R is attached to the right end side journal walls 15AR and 15BR, which serve as a right side wall portion of the crankcase 10.

In the friction clutch 60, rotational power of the crankshaft 2 is transmitted to the friction clutch 60 through the primary driving gear wheel 24 of the crankshaft 2 side and the primary driven gear wheel 61 of the friction clutch 60 side. The friction clutch 60 is configured such that, during gear change of the speed change gear 5, the friction clutch 60 establishes a neutral state without transmitting the rotational power of the crankshaft 2 to the speed change gear 5, but when the gear change of the speed change gear 5 comes to an end, the friction clutch 60 transmits the rotational power of the crankshaft 2 to the speed change gear 5.

Rotation of the main shaft 50 is transmitted to the countershaft 52 through meshing engagement between the speed change gear wheel groups 50*g* and 52*g*.

The countershaft 52 serves also as an output power shaft, and an output sprocket wheel 62 is fitted at a left end portion of the countershaft 52, which extends leftwardly through the crankcase 10 and projects to the outside and a power transmission chain 63 is stretched between the output sprocket wheel 62 and a driven sprocket wheel of a rear wheel (not shown) to configure a secondary speed reduction mechanism. Power is transmitted to the rear wheel through the secondary speed reduction mechanism.

As shown in FIG. 2, a starting driven gear wheel 64 is supported for rotation on the outer rotor 45*a* of the ac generator 45 secured to the left end of the crankshaft 2 with a one-way clutch 65 interposed therebetween.

Figure 9:
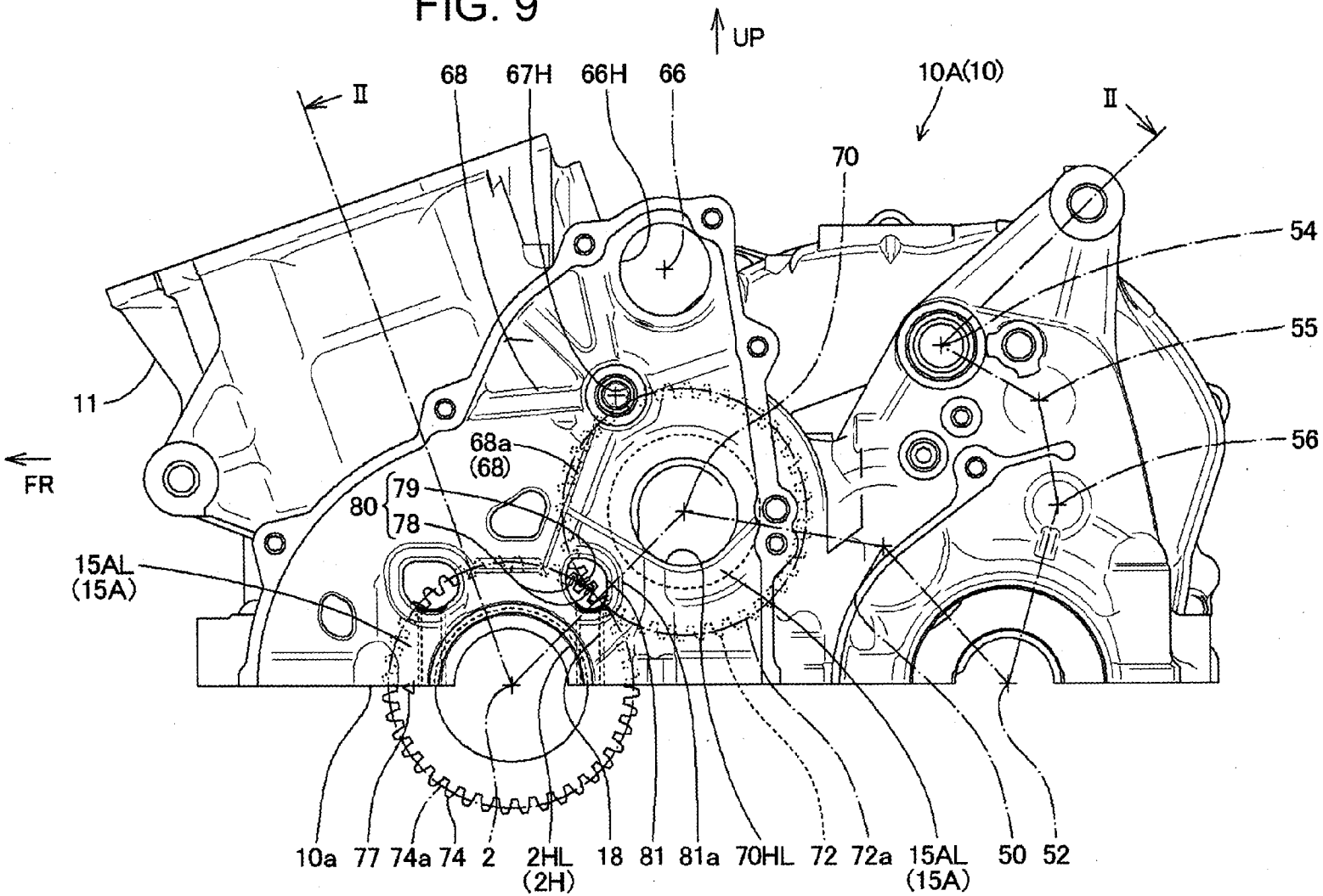
FIG. 9 is a left side elevational view as a viewed in a direction indicated by arrow marks IX-IX in FIG. 2 showing only an upper side crankcase, the balancer driving gear wheel and the balancer driven gear wheel shown in and taken out from FIG. 2. It is to be noted that, in FIG. 9, a line indicated by arrow marks II-II is a development divide line of FIG. 2.

A starter motor 66 (refer to FIG. 1) for starting the internal combustion engine 1 is attached to a position on an upper face at a mid portion of the crankcase 10 as seen from a starter motor attachment hole 66H of the upper side crankcase 10A shown in FIG. 9. Rotation of the starter motor 66 is reduced in speed by a starting speed reduction gear wheel (not shown) mounted in a speed reduction gear spindle attachment hole 67H of the upper side crankcase 10A shown in FIG. 9, and the rotation of the starting driven gear wheel 64 is transmitted to the crankshaft 2 through the one-way clutch 65 and the outer rotor 45*a* to start the internal combustion engine 1.

It is to be noted that, as shown in FIG. 9, a reinforcement rib 68 is provided on a left side outer face of the upper side crankcase 10A such that it extends around the speed reduction gear spindle attachment hole 67H and extends radially upwardly, downwardly, forwardly and rearwardly from around the speed reduction gear spindle attachment hole 67H.

It is to be noted that the internal combustion engine 1 of the present embodiment is a water-cooled internal combustion engine, and a pump shaft 26 shown in FIG. 1 is driven to rotation by a pump driving sprocket wheel 25 (refer to FIG. 2), which is supported for rotation on the main shaft 50 and rotates together with the primary driven gear wheel 61, through a driving chain and a driven sprocket wheel (not shown).

In the sectional plane shown in FIG. 1, an oil pump (not shown) is provided on the interior side of the figure while a water pump (not shown) is provided on this side of the figure. The oil pump sucks lubricating oil from the oil pan 14 through an intake conduit 27 and supplies the lubricating oil to various locations in the engine through an oil filter 28.

The water pump circulates cooling water to a water cooling jacket 29 in the cylinder block 11 and the cylinder head 12 through cooling water lines and predetermined apparatus such as a radiator and a thermostat (not shown) to cool the internal combustion engine 1.

Further, as shown in FIGS. 1 to 3, in the internal combustion engine 1 of the present embodiment, the balancer mechanism 7 including the balancer shaft 70 supported for rotation in parallel to the crankshaft 2 in the neighborhood at an oblique upper position with respect to the crankshaft 2 is provided on the upper side crankcase 10A. The balancer shaft 70 is supported for rotation on the left end side journal wall 15AL and the right end side journal wall 15AR, which form a pair of rear wall portions of the crankshaft 2, through a left bearing 71L and a right bearing 71R, respectively. In the present embodiment, the left bearing 71L and the right bearing 71R are ball bearings. Further, as viewed in side elevation, the balancer shaft 70 is disposed above a line interconnecting the crankshaft 2 and the main shaft 50 between the crankshaft 2 and the main shaft 50.

A balancer driven gear wheel 72 is attached to the balancer shaft 70 between the left end side journal wall 15AL and the right end side journal wall 15AR, which form a pair of wall portions, in an opposing relationship to the inner face of the left end side journal wall 15AL which is one of the wall portions. Further, two balance weight 73 are provided at positions corresponding to the crankpin portions 22 at two places of the crankshaft 2 in the axial direction with the phases thereof displaced by 180 degrees from each other in accordance with the two cylinders.

On the crankshaft 2, a balancer driving gear wheel 74 is fitted adjacent a left side face of the crank webs 48L from among four crank webs 48 in an opposing relationship to the inner faces of the left end side journal walls 15AL and 15BL, which are wall portions on one side, between the left end side journal walls 15AL and 15BL and the right end side journal walls 15AR and 15BR, which form a pair of wall portions. It is to be noted that the diameter D1 of the pitch circle 74*a* of the balancer driving gear wheel 74 is equal to the diameter D2 of the pitch circle 72*a* of the balancer driven gear wheel 72.

Figure 5:
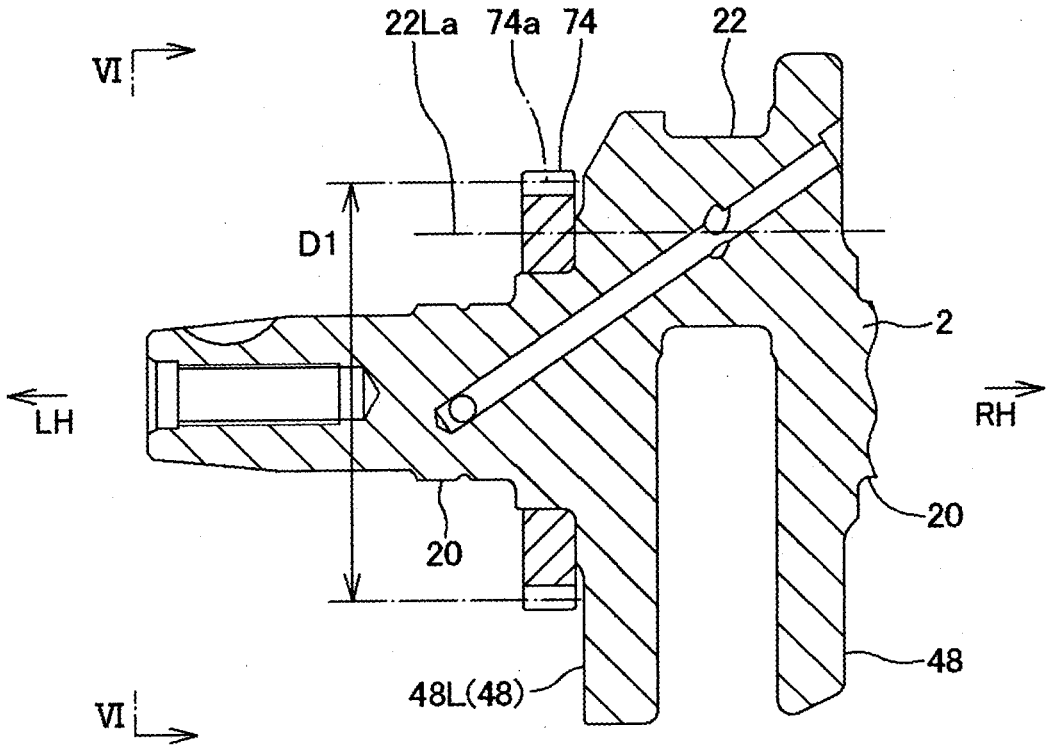
FIG. 5 is a sectional view taken in an axial direction showing a left end side of the crankshaft and a balancer driving gear wheel shown in and taken out from FIG. 2.

As the left end portion side of the crankshaft 2 and the balancer driving gear wheel 74 are shown in FIGS. 5 and 6, a driving gear wheel reference position mark 77 directed in the same direction as a displacement direction of the center axis 22La of the crankpin portion 22 on the left side with respect to the center axis of the crankshaft 2 is provided at a place rather near to the pitch circle 74*a* on a side face of the balancer driving gear wheel 74 fitted on the crankshaft 2, that is, on a side face opposing to the inner face of the left end side journal walls 15AL and 15BL. While, in the present embodiment, a triangular mark is applied, the mark may have any suitable shape and the application method may be a suitable method such as imprinting, punching or marking so that it can be visually observed readily.

On a side face of the balancer driving gear wheel 74 on the same side as the driving gear wheel reference position mark 77, a driving side mesh mark 78 indicative of a position at which the balancer driving gear wheel 74 meshes in a predetermined phase relationship with the balancer driven gear wheel 72 is applied to a place rather near to the pitch circle 74*a* on a side face of two teeth juxtaposed at a position on the rear side by a predetermined pitch in the rotational direction R upon operation from the driving gear wheel reference position mark 77, that is, on the side face of the balancer driving gear wheel 74. The mark may have any suitable shape and the application method may be a suitable method such as imprinting, punching or marking so that it can be visually observed readily.

Figure 8:
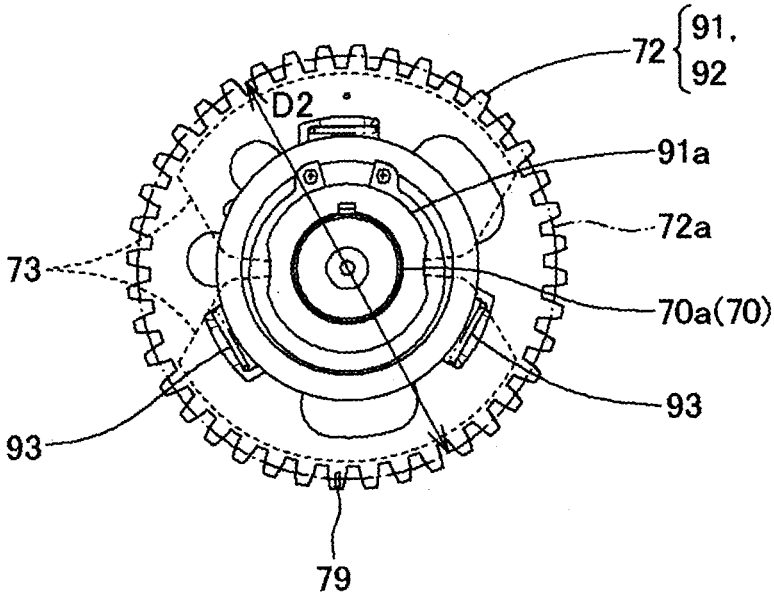
FIG. 8 is a view taken in directions indicated by arrow marks VIII-VIII in FIG. 7.

Meanwhile, as the balancer shaft 70 and the balancer driven gear wheel 72 are shown in FIGS. 7 and 8, a driven side mesh mark 79 indicative of a position at which the balancer driven gear wheel 72 meshes with the balancer driving gear wheel 74 is applied to a side face of one tooth at a position of a pitch that has a predetermined phase relationship with the position of the balance weights 73 at a place rather near to the pitch circle 72*a* on the left side face of the balancer driven gear wheel 72 secured to the balancer shaft 70 by a key 70*c*, that is, on a side face opposing to the inner face of the left end side journal wall 15AL. The mark may have any suitable shape and the application method may be a suitable method such as imprinting, punching or marking so that it can be visually observed readily.

When the driven side mesh mark 79 on the side face of the one tooth of the balancer driven gear wheel 72 is positioned between and meshes with the driving side mesh marks 78 on the side face of the two juxtaposed teeth of the balancer driving gear wheel 74, a positioning mark 80 formed from one set of marks provided on the side faces of the two gear wheels in the same direction is formed, and the balancer driving gear wheel 74 and the balancer driven gear wheel 72 are combined with each other in the predetermined phase relationship. As a result, the crankshaft 2 and the balance weights 73 of the balancer shaft 70 have the predetermined phase relationship with each other.

It is to be noted that the balancer driven gear wheel 72 in the present embodiment includes a so-called scissors mechanism. In particular, the balancer driven gear wheel 72 has a two-part structure of a main gear wheel 91 and a sub gear wheel 92 in the gear wheel axial direction, and the main gear wheel 91 and the sub gear wheel 92, which has a smaller gear wheel width, are superposed with each other in the axial direction and both mesh with the balancer driving gear wheel 74 which is the other gear wheel.

The main gear wheel 91 is fixed supported on the balancer shaft 70 by the key 70*c* while the sub gear wheel 92 is fitted for free rotation on a boss 91*a* of the main gear wheel 91. The main gear wheel 91 and the sub gear wheel 92 have an equal diameter and an equal pitch and both mesh between the same teeth of the balancer driving gear wheel 74, and a biasing member 93 is interposed between the two gear wheels such that the gear wheels are biased to rotate in the opposite directions to each other.

When the balancer driving gear wheel 74 drives the balancer driven gear wheel 72 to rotate, a trailing face of a tooth of the main gear wheel 91 of the balancer driven gear wheel 72 in the rotation direction is contacted with and pushed by a leading face side of a tooth of the balancer driving gear wheel 74. Meanwhile, although a backlash tends to appear on the front face side of the tooth of the main gear wheel 91, since the sub gear wheel 92 is biased to rotate in the opposite direction to that of the main gear wheel 91 by the biasing member 93, the leading face of the tooth of the sub gear wheel 92 is contacted with and pushes the trailing face side of the leading tooth of the balancer driving gear wheel 74 on the leading face side of the tooth of the main gear wheel 91 to substantially eliminate the backlash.

Accordingly, since the balancer driven gear wheel 72 can mesh without a play in the meshing region thereof with the balancer driving gear wheel 74, generation of gear wheel noise or the like when rotational power is transmitted to the balancer driven gear wheel 72 can prevented. This is particularly effective upon rotational power transmission with a rotational shaft that includes vibration components such as the crankshaft 2.

It is to be noted that, in the present embodiment, also the primary driving gear wheel 24 includes a scissors mechanism as shown in FIG. 2. Although the primary driving gear wheel 24 is a driving side gear wheel conversely to the balancer driven gear wheel 72, the function of the scissors mechanism is similar.

In FIG. 9, only the upper side crankcase 10A, balancer driving gear wheel 74 and balancer driven gear wheel 72 in a state in which the balancer mechanism 7 is assembled are selectively shown.

Upon assembly, the crankshaft 2 and the balancer shaft 70 are assembled to the upper side crankcase 10A in a state in which the balancer driving gear wheel 74 and the balancer driven gear wheel 72 mesh with each other such that the driven side mesh mark 79 on the side face of the one tooth of the balancer driven gear wheel 72 is positioned between the driving side mesh marks 78 on the side face of the two juxtaposed teeth of the balancer driving gear wheel 74. In this state, the crankshaft 2 and the balancer shaft 70 have the predetermined phase relationship as described hereinabove.

A through-hole 81 is provided in the left end side journal wall 15AL in conformity with the position of the positioning mark 80 composed of the driving side mesh mark 78 and the driven side mesh mark 79 when the driving gear wheel reference position mark 77 applied to the balancer driving gear wheel 74 attached to the crankshaft 2 is positioned on the parting face 10*a* of the upper side crankcase 10A and the lower side crankcase 10B in the state described above.

In particular, the through-hole 81 extending through the left end side journal wall 15AL is provided at the position of the left end side journal wall 15AL opposing to the positioning mark 80 in the state described above, at which the left end side journal wall 15AL opposes to both of the side faces of pitch circles 74*a* and 72*a* of the balancer driving gear wheel 74 and the balancer driven gear wheel 72. Accordingly, the positioning mark 80 can be visually observed straightly from the outer side of the left end side journal wall 15AL through the through-hole 81.

In particular, even if the balancer driving gear wheel 74 and the balancer driven gear wheel 72 are disposed between the left end side journal wall 15AL and the right end side journal wall 15AR that configure a pair of wall portions of the crankcase 10, since the through-hole 81 for confirming the positioning mark 80 therethrough is disposed at a position of the left end side journal wall 15AL opposing to the positioning mark 80 which opposes to both of the side faces of the pitch circles 74*a* and 72*a* of the balancer driving gear wheel 74 and the balancer driven gear wheel 72, alignment of the positioning mark 80 for adjusting the timings (predetermined phase relationship) of both of the balancer driving gear wheel 74 and the balancer driven gear wheel 72 can be confirmed readily from the front through the through-hole 81. Accordingly, assembly of the balancer shaft 70 is facilitated, which contributes to accuracy in assembly and reduction in cost.

The effects of the through-hole 81 are effective irrespective of the form of the crankcase of the internal combustion engine.

It is to be noted that, since the through-hole 81 is formed as an elongated circle that is elongated along a circumferential direction of the pitch circles 74*a* and 72*a* of the balancer driving gear wheel 74 and the balancer driven gear wheel 72, the confirmation can be carried out over a wide range and the confirmation of alignment of the positioning mark 80 is further facilitated.

Further, since the diameter D1 of the pitch circle 74*a* of the balancer driving gear wheel 74 is equal to the diameter D2 of the pitch circle 72*a* of the balancer driven gear wheel 72, the position of the through-hole 81 is disposed at equal distances from the center axis of the crankshaft 2 and the center axis of the balancer shaft 70, and the through-hole 81 is not one-sided to any of crankshaft left supporting hole crankshaft left supporting holes 2HL provided in the left end side journal walls 15AL and 15BL and crankshaft right supporting holes 2HR of the balancer shaft 70. Thus, the rigidity of the crankcase 10 is assured.

The crankcase 10 of the present embodiment is structured such that it is configured from two upper and lower parts across the parting face 10*a* centered at the crankshaft 2, and the balancer shaft 70 is supported for rotation on the upper side crankcase 10A in a spaced relationship from the parting faces 10*a*.

Accordingly, the through-hole 81 positioned intermediately between the crankshaft 2 and the balancer shaft 70 can be formed as a closed hole spaced from the parting faces 10*a* and does not have a cutaway shape as in the case where a through-hole is provided between the parting faces 10*a*. Therefore, the rigidity of the crankcase 10 is assured.

It is to be noted that, since the crankcase 10 in the present embodiment is not structured such that it is formed from two left and right parts separate from each other, although there is the possibility that it may become difficult to observe the meshing region between the balancer driving gear wheel 74 and the balancer driven gear wheel 72 straightly from the opposite side of the crankcase to confirm alignment of the positioning mark, since the through-hole 81 is provided as in the present embodiment, it becomes possible to visually observe the meshing region between the balancer driving gear wheel 74 and the balancer driven gear wheel 72 in the crankcase 10 of the structure including two upper and lower parts in the present embodiment to easily confirm alignment of the positioning mark 80.

Further, as seen in FIG. 9, the outer periphery of the through-hole 81 is surrounded by a rib 81*a* and the surroundings of the through-hole 81 are reinforced to achieve enhancement in strength of the crankcase 10. Further, the rib 81*a* surrounding the outer periphery of the through-hole 81 connects, around the through-hole 81, to a vertical rib 68*a* extending in the upward and downward direction from within a reinforcement rib 68 for the speed reduction gear spindle attachment hole 67H of the left end side journal wall 15AL, and the rib 81*a* surrounding the through-hole 81 is further reinforced.

It is to be noted that female threaded holes 18 for the stud bolts 17 for fastening the upper side crankcase 10A and the lower side crankcase 10B to each other are provided in an upwardly directed state from the parting face 10*a* in the front and rear of the crankshaft left supporting hole 2HL of the left end side journal wall 15AL as shown in FIG. 9, and an end of the female threaded holes 18 in the rear extends to the through-hole 81.

Therefore, upon working of the female threads, cut chips can be removed readily, and therefore, the working is facilitated. Further, by screwing and tightening of the stud bolts 17, the stress concentration acting around the female threaded holes 18 can be reduced, and improvement in strength of the crankcase 10 is achieved. It is to be noted that, for this object, also an end of the female threaded holes 18 extends to another through-hole.

Further, the through-hole 81 is formed by casting through upon casting of the upper side crankcase 10A, and such casting through formation eliminates mechanical working and decreases the man-hour in working.

In the internal combustion engine 1 of the present embodiment, since the balancer shaft 70 and the main shaft 50 are supported on the upper side crankcase 10A above the parting face 10*a* of the crankcase 10, attachment utilizing the parting face 10*a* cannot be carried out.

Therefore, the right shaft end portion 70*b* of the balancer shaft ("rotational shaft" of the present invention) 70 is supported on the right end side journal wall ("wall portion" of the present invention) 15AR by operating, in a state in which the right shaft end portion 70*b* is loosely fitted in a balancer shaft right supporting hole 70HR of the right end side journal wall 15AR, which forms the right side wall portion from between a pair of wall portions of the crankcase 10, a left shaft end portion 70*a* to be supported on the balancer shaft left supporting hole 70HL of the left end side journal wall 15AL, which serves as the left side wall portion though the left bearing 71L, and then inserting and fitting the right bearing ("bearing" of the present invention) 71R onto the right shaft end portion 70*b* of the balancer shaft 70 from the right side into the balancer shaft right supporting hole 70HR.

Also the right shaft end portion 50*b* of the main shaft ("second rotational shaft" of the present invention) 50 is supported on the right end side journal wall 15AR by operating, in a state in which the right shaft end portion 50*b* is loosely fitted in the main shaft right supporting hole 50HR of the right end side journal wall 15AR, which forms the right side wall portion from between a pair of wall portions of the crankcase 10, a left shaft end portion 50*a* to be supported on the main shaft left supporting hole 50HL of the left end side journal wall 15AL, which serves as the left side wall portion though the left bearing 51L, and then inserting and fitting the right bearing ("second bearing" of the present invention) 51R onto the right shaft end portion 50*b* of the main shaft 50 from the right side into the main shaft right supporting hole 50HR.

In other words, not only the balancer shaft 70 but also the main shaft 50 is supported for rotation at the right shaft end portions 70*b* and 50*b* on the right bearings 71R and 51R, which are fitted in and secured to the right supporting holes 70HR and 50HR of the right end side journal wall 15AR, respectively. Accordingly, although the right bearings 71R and 51R are fitted from the right side into and secured to the right end side journal wall 15AR, which is the right side wall portion, it is necessary to prevent inadvertent coming off thereof by vibration or the like upon operation of the internal combustion engine 1, and a bearing restriction member 100 is attached to a right face of the right end side journal wall 15AR.

In the present embodiment, the bearing restriction member 100 is formed in such a shape that, as shown in FIG. 4, it is disposed, in an attached state thereof, along a side face rather near to an outer periphery of the right bearing 71R of the balancer shaft 70 and extends to and is disposed on a side face rather near to an outer periphery of the right bearing 51R of the main shaft 50. Thus, the bearing restriction member 100 serves also as a bearing restriction member for the main shaft 50 and is fastened to the right face of the right end side journal wall 15AR by bolts 101 (refer also to FIGS. 10 and 11). Therefore, the bearing restriction member 100 can be used also as a bearing restriction member for the right bearing 51R of the main shaft 50 without providing the latter separately, which makes it possible to reduce the number of parts.

Further, as shown in FIG. 3, the shift fork supporting shaft ("further shaft" of the present invention) 56 is fitted from the right side in and extends through a shift fork supporting shaft right supporting hole 56HR of the right end side journal wall 15AR until a left shaft end portion 56*a* thereof is fitted in and supported by a shift fork supporting shaft left supporting hole 56HL of the left end side journal wall 15AL while a right shaft end portion ("shaft end portion of the further shaft" of the present invention) 56*b* is supported on the right end side journal wall 15AR, which is a right side wall portion of the crankcase 10, by the shift fork supporting shaft right supporting hole 56HR. Accordingly, although it is necessary for the shift fork supporting shaft 56 to be provided with a coming off preventing device for restricting the right shaft end portion 56*b* thereof in order to prevent inadvertent coming off of the same, in the present embodiment, the bearing restriction member 100 is formed such that, in an attached state thereof, it extends to the right shaft end portion 56*b* of the shift fork supporting shaft 56 such that a rear end extension 100*e* thereof contacts with the right shaft end portion 56*b* (refer also to FIGS. 3, 10 and 11).

Therefore, the bearing restriction member 100 can be used also as the coming off preventing device for the shift fork supporting shaft 56 without providing the same separately, which makes it possible to reduce the number of parts.

In an internal combustion engine wherein the crankcase 10 is formed as a crankcase of an upper and lower two-part configuration and the oil pan 14 is provided at a lower portion of the crankcase 10 while the balancer shaft 70 and the main shaft 50 are provided on the upper side crankcase 10A like the internal combustion engine 1 of the present embodiment, it is difficult to carry out lubrication in such a manner that some of the bearings and gear wheels of the speed change gear 5 are dipped in oil, and supply of lubricating oil by an oil pump is carried out.

Also in the present embodiment, in the main shaft 50 of the speed change gear 5, an oil passage 50*c* to which oil is supplied from the oil pump is provided as oil supplying device in order to lubricate the left and right bearings 51L and 51R, speed change gear wheel group 50*g* and so forth.

However, in the internal combustion engine 1 of the present embodiment, a lubrication structure for a bearing section wherein an oil receiving portion 110 is provided in the right end side journal wall AR, which is a right side wall portion of the crankcase 10, is provided for the bearing portions for the balancer shaft 70.

Figure 10:
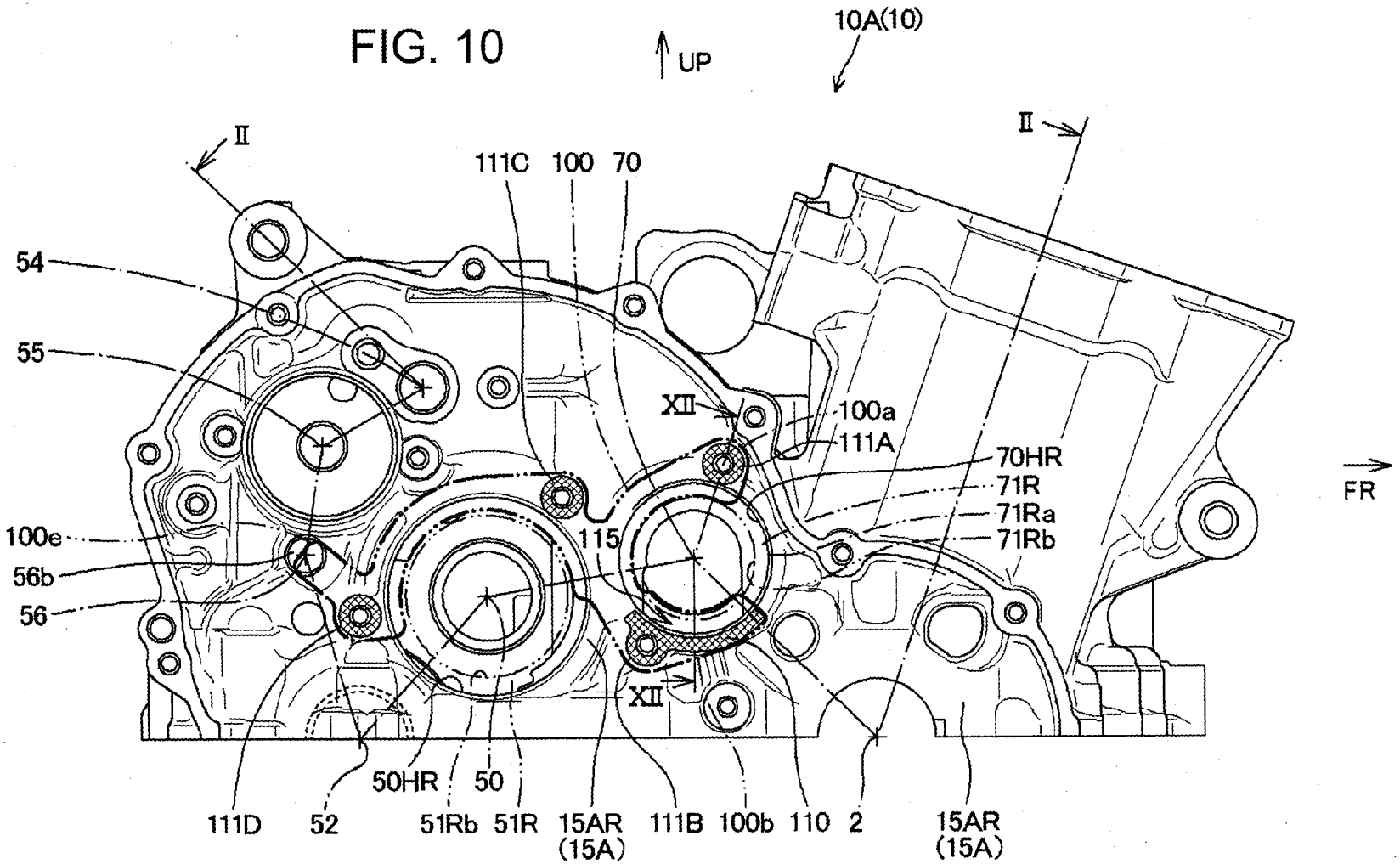
FIG. 10 is a right side elevational view as a view indicated by an arrow mark X-X in FIG. 2 and showing only the upper side crankcase shown in and taken out from FIG. 2 and shows the position of an oil receiving section. It is to be noted that, in FIG. 10, a line indicated by arrow marks II-II is a development divide line of FIG. 2. Further, a bearing restricting member in an attached state is indicated by a thick alternate long and two short dashes line.
Figure 11:
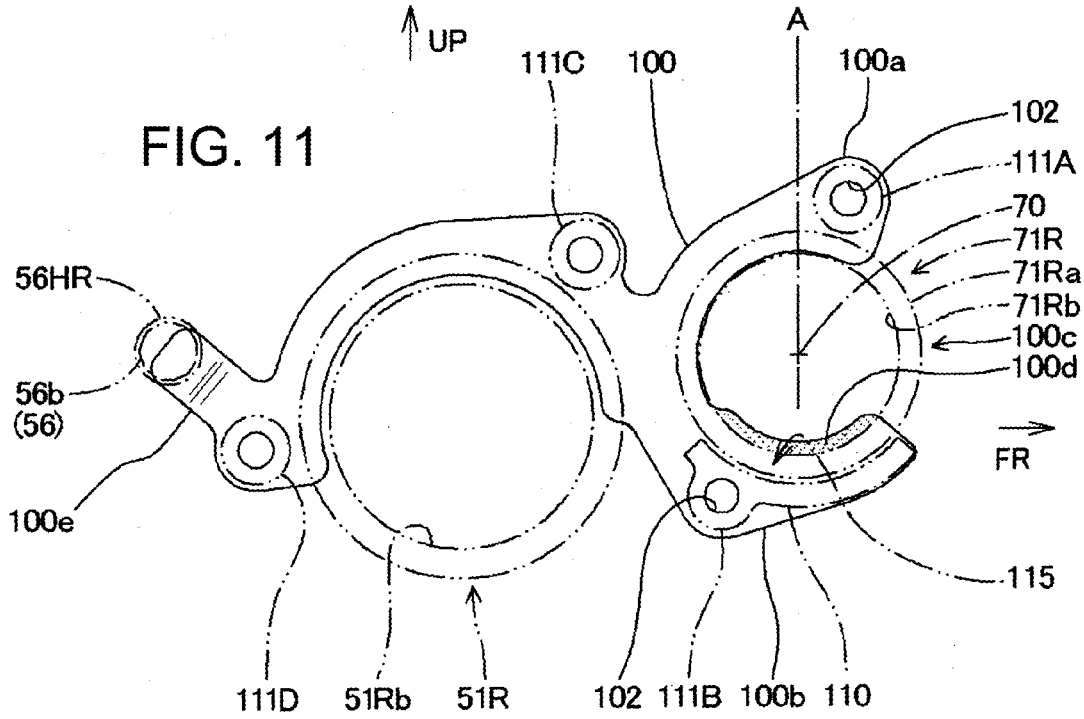
FIG. 11 is a front elevational view of the bearing restricting member which is indicated by the thick alternate long and two short dashes lines in FIG. 10 when it is in the attached state.
Figure 12:
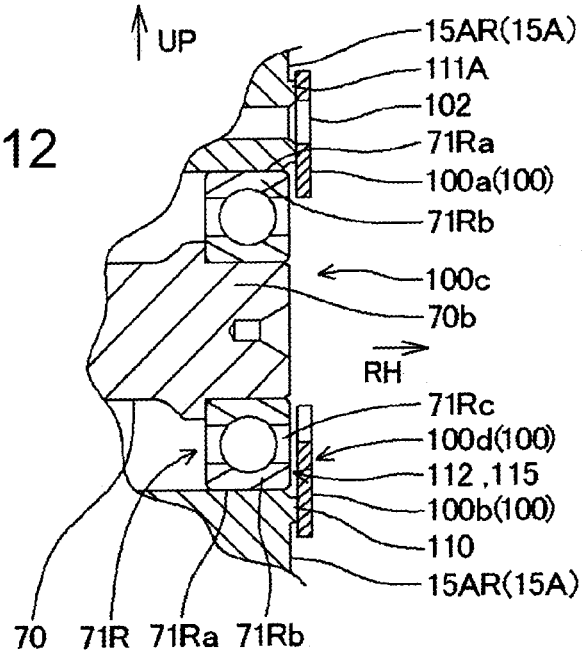
FIG. 12 is an explanatory view corresponding to a sectional view taken along line XII-XII in FIG. 10 and schematically illustrating an attached state of a main shaft, the oil receiving section around a main shaft right bearing, and the bearing restricting member.

In particular, as shown in FIGS. 10-12, the oil receiving portion 110 formed in a swollen state like a trapezoidal shape to a fixed height along an outer periphery 71Ra is provided on a right face of the right end side journal wall 15AR on the outer side of an outer periphery 71Ra below the center axis of the right bearing 71R.

Further, the bearing restriction member 100 for suppressing coming off of the right bearing 71R is provided on the side face of an outer race portion 71Rb of the right bearing 71R as described hereinabove.

The oil receiving portion 110 extends along the outer periphery 71Ra on the right end side journal wall 15AR below the center axis of the right bearing 71R and is formed in an arcuate shape, which is concave in an upward direction.

Meanwhile, boss portions 111A, 111B, 111C and 111D of fastening device for the bearing restriction member 100 in the form of a plate are formed in order at positions above and below the balancer shaft 70 and on the front and the rear of the main shaft 50 on the right face of the right end side journal wall 15AR. The bearing restriction member 100 is fastened to the boss portions by bolts 101 (refer to FIG. 4) fitted in attachment holes 102 (refer to FIG. 11) in the boss portions to secure the bearing restriction member 100 to the right face of the oil receiving portion 110.

Although the bearing restriction member 100 has a function for preventing coming off of the right bearing 71R, in a state in which the bearing restriction member 100 is attached to the oil receiving portion 110, an oil reserve section 115 (refer to FIGS. 11 and 12) is formed over the oil receiving portion 110 and the bearing restriction member 100 and can accumulate oil therein, which makes lubrication of the right bearing 71R possible.

Further, since the bearing restriction member 100 is formed such that it extends toward the center axis of the right bearing 71R of the balancer shaft 70 from the oil receiving portion 110 and extends along a side face rather near to the outer periphery 71Ra of the right bearing 71R, the capacity of the oil reserve section 115 increases, and oil supply to the right bearing 71R is carried out more preferably.

In particular, if an attachment state of the right bearing 71R, oil receiving portion 110 and bearing restriction member 100 to the right shaft end portion 70*b* of the balancer shaft 70 is schematically shown in FIG. 12, then since the bearing restriction member 100 secured to the right face of the oil receiving portion 110 by fastening is a coming off preventing member, in the case where a bearing fitted therein becomes loose, the bearing restriction member 100 does not press against the outer race portion 71Rb of the right bearing 71R, and between the bearing restriction member 100 and the side face of the outer race portion 71Rb, a fixed gap 112 exists in accordance with the swell of the oil receiving portion 110 and the oil reserve section 115 is formed.

Therefore, lubricating oil scattered between the crankcase 10 and the right crankcase cover 47R and sticking to the surface of the right end side journal wall 15AR flows down along the wall face and is accumulated into the gap 112 between the side face rather near to the outer periphery 71Ra of the right bearing 71R and the bearing restriction member 100, that is, in the oil reserve section 115 and besides flows into the right bearing 71R, whereby lubrication of the bearing section of the balancer shaft 70 is permitted.

Accordingly, the lubrication structure for the bearing section including the simple oil supplying device that can utilize the bearing restriction member 100 to lubricate the right bearing 71R of the balancer shaft 70 without providing a special oil supplying device is obtained.

Further, since the oil receiving portion 110 is formed in an arcuate shape, which is concave upwardly along the outer periphery 71Ra of the right bearing 71R, the oil amount to be accumulated in the oil reserve section 115 can be increased.

Further, the bearing restriction member 100 is formed such that the portion thereof that extends father than the oil receiving portion 110 toward the center axis of the right bearing 71R has a center side extension 100*d* that extends farther than the outer race portion 71Rb of the right bearing 71R secured to the right end side journal wall 15AR to the center axis side of right bearing 71R (refer to FIGS. 11 and 12). Accordingly, oil is supplied positively to a sliding location of a ball rolling portion 71Rc of the right bearing 71R by the center side extension 100*d* extending toward the center axis side of the bearing farther than the outer race portion 71Rb of the right bearing 71R, and the lubrication is carried out more preferably.

Further, as shown in FIGS. 10 and 11, a boss portion 111A of the fastening device for attaching the bearing restriction member 100 to the right end side journal wall 15AR above the balancer shaft 70 is disposed in a displaced relationship from just above (in FIG. 11, the direction indicated by an arrow mark A) the center axis of the right bearing 71R of the balancer shaft 70. Where the boss portion 111A above the balancer shaft 70 is positioned just above A of the center axis of the right bearing 71R, there is the possibility that inflow of oil into the oil receiving portion 110 may be obstructed. However, in the present embodiment, such a defect as just described is suppressed and stabilized lubrication is obtained.

Further, the bearing restriction member 100 extends upwardly and downwardly with respect to the balancer shaft 70, and on the rear side, the upper portion 100*a* and the lower portion 100*b* thereof connect to each other and the bearing restriction member 100 further extends upwardly with respect to the main shaft 50. However, on the front side of the balancer shaft 70, a portion of the bearing restriction member 100 between the upper portion 100*a* and the lower portion 100*b* with respect to the balancer shaft 70 forms a cutaway portion 100*c* (refer to FIG. 11), which is cut away.

If the bearing restriction member 100 is formed annularly around the balancer shaft 70, then there is the possibility that oil may flow down along around the annular portion and may not readily enter the bearing restriction member 100. However, in the present embodiment, since the portion of the bearing restriction member 100 between the upper portion

100*a* and the lower portion 100*b* is cut away and forms the cutaway portion 100*c*, it is easy for oil to flow from the cutaway portion 100*c* into the oil receiving portion 110, and stabilized lubrication is obtained.

It is to be noted that the lower boss portion 111B of the balancer shaft 70 described above for fastening the bearing restriction member 100 is formed integrally with the oil receiving portion 110 on the right end side journal wall 15AR (refer to FIGS. 10 and 11), and by the integration of the boss portion 111B of the fastening device, the rigidity around the oil receiving portion 110 is enhanced.

While lubrication structure for a bearing section of an embodiment of the present invention has been described, the present invention naturally includes various modes different from the embodiment without departing from the subject matter of the claims.

For example, the internal combustion engine that includes the lubrication structure for a bearing section of the present invention is not limited to the water-cooled straight two-cylinder four-stroke cycle internal combustion engine of the embodiment described above but may be any of various internal combustion engines having the configuration set forth in the claims appended hereto, and where the lubrication structure for a bearing section is incorporated in a vehicle, the vehicle is not limited to a motorcycle, and the internal combustion engine is not limited to an internal combustion engine for being incorporated in a vehicle. Further, the crankcase is not limited to that of the structure of the embodiment if it includes a "bearing restriction member" for a bearing for a rotational shaft, but the present invention can be applied effectively to crankcases of various structures. Further, the "wall portion" in the claims is not limited to the right end side journal wall in the embodiment; the "bearing" and the "rotational shaft" are not limited to that for the balancer shaft and the balancer shaft; the "other rotational shaft" is not limited to the main shaft; the "other shaft" is not limited to the shift fork supporting shaft; and the present invention is applied effectively to any other element which complies with the subject matter of any of the claims.

DESCRIPTION OF REFERENCE SYMBOLS

1 . . . Internal combustion engine (internal combustion engine with a balancer), 2 . . . Crankshaft, 3 . . . Piston, 5 . . . Speed change gear, 7 . . . Balancer mechanism, 10 . . . Crankcase, 10*a* . . . Parting face, 10A . . . Upper side crankcase, 10B . . . Lower side crankcase, 14 . . . Oil pan, 15A . . . Journal wall, 15B . . . Journal wall, 15AL . . . Left end side journal wall (left side wall portion from between a pair of wall portions), 15BL . . . Left end side journal wall (left side wall portion from between a pair of wall portions), 15AR . . . Right end side journal wall (right side wall portion from between a pair of wall portions; "wall portion" of the present invention), 15BR . . . Right end side journal wall (right side wall portion from between a pair of wall portions), 47R . . . Right crankcase cover, 50 . . . Main shaft ("second rotational shaft" of the present invention), 50*b* . . . Right shaft end portion, 50*b* . . . Right shaft end portion, 51R . . . Right bearing ("second bearing" of the present invention), 51Rb . . . Outer race portion, 52 . . . Countershaft, 54 . . . Shift spindle, 55 . . . Shift drum, 56 . . . Shift fork supporting shaft ("further shaft" of the present invention), 56*b* . . . Right shaft end portion ("shaft end portion of the further shaft" of the present invention), 60 . . . Friction clutch, 70 . . . Balancer shaft ("rotational shaft" of the present invention), 70*b* . . . Right shaft end portion, 70HR . . . Balancer shaft right supporting hole, 71R . . . Right bearing ("bearing" of the present invention), 71Ra . . . Outer periphery, 71Rb . . . Outer race portion, 71Rc . . . Ball rolling portion, 100 . . . Bearing restriction member, 100*a* . . . Upper portion, 100*b* . . . Lower portion, 100*c* . . . Cutaway portion, 100*d* . . . Center side extension, 100*e* . . . Rear end extension, 110 . . . Oil receiving portion, 111A to 111D . . . Boss portion, 112 . . . Fixed gap, 115 . . . Oil reserve section

What is claimed is:

1. A lubrication structure for a bearing section of an internal combustion engine comprising:

a crankcase having a wall portion;

a bearing secured to the wall portion;

a rotational shaft supported for rotation by the bearing; and a bearing restriction member disposed on a side face of an outer race portion of the bearing and configured to suppress the bearing from coming off of the wall portion, wherein an oil receiving portion formed in a swollen state on the wall portion along an outer periphery, and below a center axis, of the bearing, and an oil reserve section is provided so as to extend over the oil receiving portion and the bearing restriction member.

2. The lubrication structure for the bearing section according to claim 1, wherein the bearing restriction member is formed so as to extend, in a state in which the bearing restriction member is attached to the oil receiving portion, from the oil receiving portion toward the center axis of the bearing and extend at least along a side face rather near to the outer periphery of the bearing.

3. The lubrication structure for the bearing section according to claim 1, wherein the oil receiving portion is formed in an arcuate shape that extends along the outer periphery of the bearing and is concave in an upward direction.

4. The lubrication structure for the bearing section according to claim 1, wherein the bearing has an outer race portion secured to the wall portion, and the bearing restriction member is formed such that a portion thereof that extends toward the center axis of the bearing from the oil receiving portion extends to the center axis side of the bearing farther than the outer race portion.

5. The lubrication structure for the bearing section according to claim 1, wherein the bearing is a first bearing and the rotational shaft is a first rotational shaft, and wherein said bearing restriction member serves also as a bearing restriction member for a second bearing for a second rotational shaft positioned adjacent the first rotational shaft.

6. The lubrication structure for the bearing section according to claim 5, wherein the bearing restriction member is configured so as to extend to a shaft end portion of a further shaft supported by the wall portion, said bearing restriction member being in contact with the shaft end portion.

7. The lubrication structure for the bearing section according to claim 1, wherein a boss portion of a fastening device for attaching the bearing restriction member to the oil receiving portion is formed integrally with the oil receiving portion on the wall portion.

8. The lubrication structure for the bearing section according to claim 7, wherein the boss portion is a first boss portion and wherein a second boss portion of the fastening device for attaching the bearing restriction member to the wall portion above the rotational shaft is disposed in a displaced relationship from a position just above the center axis of the bearing of the rotational shaft.

9. The lubrication structure for the bearing section according to claim 1, wherein the bearing restriction member is formed by cutting away one of the opposite sides, which sandwich the rotational shaft therebetween, of a portion thereof between a portion positioned above the rotational shaft and another portion positioned below the rotational shaft.

10. The lubrication structure for the bearing section according to claim 2, wherein the oil receiving portion is formed in an arcuate shape that extends along the outer periphery of the bearing and is concave in an upward direction.

11. The lubrication structure for the bearing section according to claim 2, wherein the bearing has an outer race portion secured to the wall portion, and the bearing restriction member is formed such that a portion thereof that extends toward the center axis of the bearing from the oil receiving portion extends to the center axis side of the bearing farther than the outer race portion.

12. The lubrication structure for the bearing section according to claim 2, wherein the bearing is a first bearing and the rotational shaft is a first rotational shaft, and wherein said bearing restriction member serves also as a bearing restriction member for a second bearing for a second rotational shaft positioned adjacent the first rotational shaft.

13. The lubrication structure for the bearing section according to claim 12, wherein the bearing restriction member is configured so as to extend to a shaft end portion of a further shaft supported by the wall portion, said bearing restriction member being in contact with the shaft end portion.

14. The lubrication structure for the bearing section according to claim 2, wherein a boss portion of a fastening device for attaching the bearing restriction member to the oil receiving portion is formed integrally with the oil receiving portion on the wall portion.

15. The lubrication structure for the bearing section according to claim 14, wherein the boss portion is a first boss portion and wherein a second boss portion of the fastening device for attaching the bearing restriction member to the wall portion above the rotational shaft is disposed in a displaced relationship from a position just above the center axis of the bearing of the rotational shaft.

16. The lubrication structure for the bearing section according to claim 2, wherein the bearing restriction member is formed by cutting away one of the opposite sides, which sandwich the rotational shaft therebetween, of a portion thereof between a portion positioned above the rotational shaft and another portion positioned below the rotational shaft.

17. The lubrication structure for the bearing section according to claim 3, wherein the bearing has an outer race portion secured to the wall portion, and the bearing restriction member is formed such that a portion thereof that extends toward the center axis of the bearing from the oil receiving portion extends to the center axis side of the bearing farther than the outer race portion.

18. The lubrication structure for the bearing section according to claim 3, wherein the bearing is a first bearing and the rotational shaft is a first rotational shaft, and wherein said bearing restriction member serves also as a bearing restriction member for a second bearing for a second rotational shaft positioned adjacent the first rotational shaft.

19. The lubrication structure for the bearing section according to claim 18, wherein the bearing restriction member is configured so as to extend to a shaft end portion of a further shaft supported by the wall portion, said bearing restriction member being in contact with the shaft end portion.

20. The lubrication structure for the bearing section according to claim 3, wherein a boss portion of a fastening device for attaching the bearing restriction member to the oil receiving portion is formed integrally with the oil receiving portion on the wall portion.

* * * * *